United States Patent [19]

Miller et al.

[11] Patent Number: 4,907,694

[45] Date of Patent: Mar. 13, 1990

[54] COIN POUCH

[75] Inventors: Joseph T. Miller, St. Louis County; Edward F. Brown, St. Francois County, both of Mo.

[73] Assignee: MOCAP, St. Louis, Mo.

[21] Appl. No.: 307,920

[22] Filed: Feb. 9, 1989

[51] Int. Cl.[4] ..... A45C 1/02; A45C 11/32

[52] U.S. Cl. ..... 206/0.81; 206/37.1; 206/38.1; 150/150; 150/900

[58] Field of Search ..... 150/150–153, 150/900; 206/38.1, 37.1, 0.81, 0.82; 70/459

[56] References Cited

U.S. PATENT DOCUMENTS

| | | | |
|---|---|---|---|
| 1,715,348 | 6/1929 | Barbara | 150/900 X |
| 2,569,629 | 10/1951 | Everitt | 150/150 X |
| 2,616,472 | 11/1952 | Carlson | 150/900 X |
| 3,063,487 | 11/1962 | Mullin | 150/900 X |
| 3,119,429 | 1/1964 | Stiller et al. | 150/900 X |
| 3,160,186 | 12/1964 | Conley | 150/900 X |
| 3,529,649 | 9/1970 | Bennett | 206/37.1 |
| 3,918,503 | 11/1975 | Bundy | 150/150 X |
| 4,166,489 | 9/1979 | Lemelson | 206/38.1 |
| 4,739,877 | 4/1988 | Olson | 150/900 X |

FOREIGN PATENT DOCUMENTS

| | | | |
|---|---|---|---|
| 1480344 | 4/1967 | France | 206/38 |

*Primary Examiner*—Sue A. Weaver

*Attorney, Agent, or Firm*—Paul M. Denk

[57] ABSTRACT

A coin pouch including an enclosure member formed of molded polymer, rubber, or other elastomeric but resilient material, and incorporating upper and lower walls, side walls, and an end wall, with an entrance opening at its opposite end. A fastener locates at the entrance to the pouch, to secure coins or other items therein, during application. The fastener may comprise Velcro, snap clasp, or the like. The pouch is formed of a molded polymer, preferably polyvinyl chloride, and incorporates sufficient resiliency to allow for its maintenance in a generally flattened condition, for convenience of usage, but which can be compressed into opening, at its entrance, for the deposit or removal of coins from within its pouch.

4 Claims, 1 Drawing Sheet

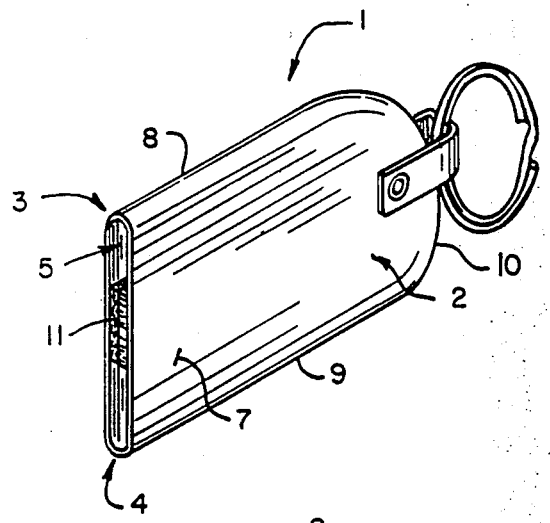
FIG.1.
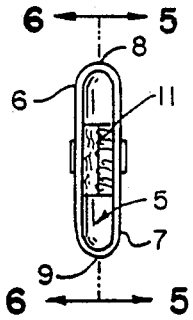
FIG.2.
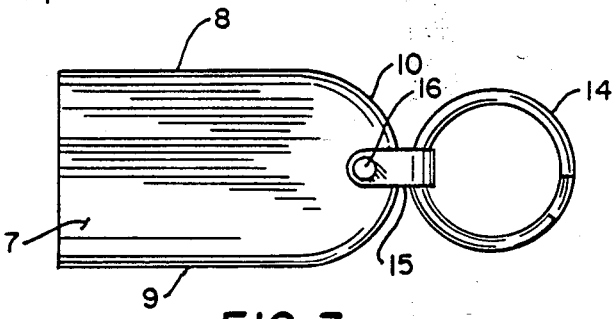
FIG.3.
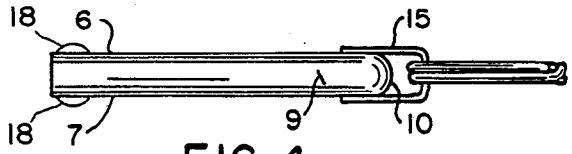
FIG.4.
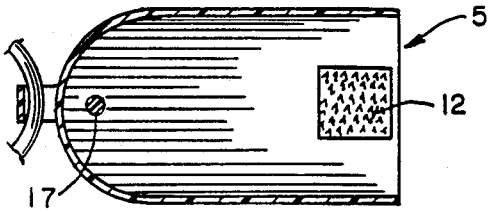
FIG.5.
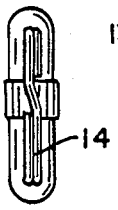
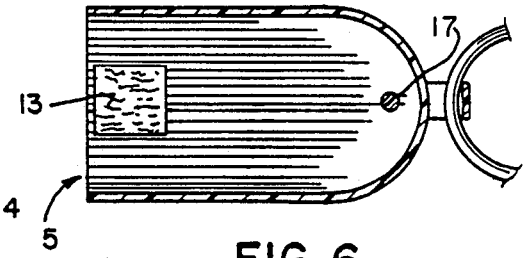
FIG.6.
FIG.7.

COIN POUCH

BACKGROUND OF THE INVENTION

This invention relates to means for holding coins or other small items of a personal capacity within a pouch, and more specifically pertains an elongated coin pouch, which has an opening away from its attached key ring, or the like, the open end capable of being resiliently urged into an opened condition for allowance of the insertion or removal of coins, or the like, therefrom, and once released, automatically snaps back into closure, and held thereat by means of fastening means.

There are a large variety of coin purses, and the like, upon the market. Many of these are manufactured of polymer materials. For example, one that is quite commonly available is a polymer formed pouch, having a double arcuate shape, but of a flattened condition, having the appearance of a flattened football, egg, or the like, and then disposes a slit down the center, approximately from end to end, upon its upper wall, such that when the ends of the embodiment are compressed together, the slit tends to open, along its length, and particularly at its central location, allowing for the disposition or removal of coins from within the same. This particular device works quite effectively during its usage, the only problem, though, that may be encountered is that there is no fastening means for securement of the slit into closure, and on occasion coins may slip out of the same, when in one's pocket, or elsewhere. Furthermore, without any fastener, the pouch slit had a tendency to remain open after repeated usage. In addition, this prior art type of purse, on occasion, may even have a key chain, or the like, secured to it, to enhance its usage.

Other types of coin pouches or purses are also available in the art, usually comprising small pocket book shaped devices, with a closure flap, and frequently incorporating a snap clasp, to secure it in its closed condition after coins are arranged therein.

SUMMARY OF THE INVENTION

The principle object object of this current invention is to provide a coin pouch which is inherently resilient, but of a different design from those of the prior art, and wherein a compression of the body or enclosure portion of it urges a readily available and free end into an opened condition, for the immediate insertion of any coins therein, or removal of the same, and upon release, resiliently forces the pouch back into closure, where a closure means, such as a hook and pile type of fastening means, may secure the same, and any coins therein, in a safe condition within its enclosed member.

This invention contemplates the usage of the inherent resiliency provided through the usage of select polymers, in this particular instance, preferably, a polyvinyl chloride, and maintained within a specific Shore hardness range to provide inherent resiliency, to provide for the operative attributes of this pouch during usage. The pouch is a form of elongated flattened cylinder, formed having an upper and a lower wall, integrally formed together with side edge walls, and a back end wall, while the opposite end is maintained freely opened, but normally biased into closure, due to the inherent resiliency of the polymer forming the enclosure member of this invention. A compression of the enclosure member, along its side edge walls, proximate the entrance opening, at one end, forces the opening into a more oval or circular configuration, to provide free entrance into the pouch, for the deposit or removal of coins from there within, as may be required. At this location, along the interior surfaces of the preferably upper and lower walls of the enclosure member, a form of fastening means may be provided, such as one formed of Velcro, which is a hook and pile style of fastening means, such that when the upper and lower walls are brought into proximity with each other, as when released from lateral compression, allows this hook and pile fastening means to come into proximity with each other, and through a slight squeeze, causes their interlocking together, for reasonably snug securement of any coins within the pouch. On the other hand, as previously explained, a lateral compression, from side to side, upon the enclosure member, and with a slight insertion of the thumb or other finger at the entrance of the pouch, releases the grip of the hook and pile fastening means from upon each other, thereby allowing for a compressed opening of the enclosure member, at this location, to attain the necessary access into the pouch, as may be required. The advantages of this particular invention, principally, is that it affords a very quick means for direct entrance into the pouch, to attain access to a few coins, without any interference from other types of links, closure members, or the like, but yet sustains closure once closed.

At the opposite end of the enclosure member, such as at that end opposite from its entrance opening, there may be provided a key ring, chain, or the like, preferably held into position with the enclosure member by means of any form of link, such as a polymer formed clasp type of link, that secures the key ring or chain into position, for holding a variety of keys, as usually desired by any one in possession of door keys, home and office keys, car keys, and the like.

A primary object of this invention is to provide a coin pouch with an opening that is readily disposed for easy access. Yet another object of this invention is to provide a coin pouch fabricated to inherently function to provide for its convenient opening, and self closure, simply through one-handed manipulation by its user.

A further object of this invention is to provide a pouch of the previously stated type, and which incorporates fastening means for ready securement of the pouch into closure, during application.

Another object of this invention is to include closure means for a pouch which is generally concealed from view, upon viewing of the pouch, but is readily accessible to manipulation, as required, to attain an opening or closing of it during usage.

Still another object of this invention is to provide a polymer form of pouch that can be readily used and applied with a key ring, key chain, or the like.

Still another object of this invention is to provide a rather compact and small sized coin pouch, that can be readily used in combination with other personal accessories, and yet being of sufficient size, having a desired interior capacity for holding a variety of coins, for ready usage, but yet not affording any significant bulk that may be in evidence when stored in one's pocket.

These and other objects will become more apparent to those skilled in the art upon reviewing the description of the preferred embodiment, in view of its drawings.

BRIEF DESCRIPTION OF THE DRAWINGS

In referring to the drawings,

FIG. 1 is an isometric view of the coin pouch of this invention;

FIG. 2 is a front view thereof;

FIG. 3 is a top plan view thereof;

FIG. 4 is a side view thereof;

FIG. 5 is a transverse section taken along the line 5—5 of FIG. 2;

FIG. 6 is a transverse section taken along the line 6—6 of FIG. 2; and FIG. 7 is a back end view thereof.

DESCRIPTION OF THE PREFERRED EMBODIMENT

In referring to the drawings, and in particular FIGS. 1, 3 and 4, the coin pouch 1 of this invention is readily disclosed, incorporating an enclosure member 2, which, as can be seen, has greater length than width, and which has a thickness that is substantially flattened, so as to conveniently locate within the pocket, or the like, during usage, and not be in evidence during usage. The pouch of this invention is integrally molded from vinyl material, as an enclosure, and preferably formed from polyvinyl chloride, by means of custom polymer molding methods that are readily available in the art. It is required that the pouch of this invention inherently possess some natural resiliency, in order to sustain, in the steady state condition, the flattened configuration as shown in FIGS. 1 and 2. On the other hand, when one transversely compresses the end edges, at approximately the locations 3 and 4, as through the exertion of finger pressure, the pouch will compress into an opening, proximate its entrance 5, to allow for the ready insertion, or removal, of any coins, or other items, from within the formed cavity of the enclosure member 2. Thus, the resiliency inherent in the type of polymer molded into the configuration of this coin purse, is rather critical, and it has been found, through experimentation and practice, that a molded polymer having a Shore hardness of between about seventy to seventy-five has been found quite desirable for functioning for the purposes of this invention. And, the thickness of the polymer, when functioning in this capacity, has been found quite desirable to be in the vicinity of one-sixteenth inch, more or less.

Obviously, material formulations for the polymer used will determine those changes that may be essential for the final product with respect to its texture, hardness, color reception, material thickness, in addition to endurance, after sustained usage. Furthermore, the usage of vinyl material in the formation of the coin pouch of this invention allows for the creating of rather unique molding, that is receptive to any imprinted or bonded message, company name, product advertising, or other designs, into or onto the exposed polymer surfaces of this coin pouch. Fused glossy inks applied to the polymer surfaces gives the appearance of a two part molding, for furnishing a rather lasting impression from this created device. Any ink applied to this type of vinyl material, when fabricated into a coin pouch, normally resists wear, fading, flexing, or even when it comes in contact with any other chemicals such as to resist deterioration.

As can be seen from the drawings, the enclosure member 2 of this invention includes an upper wall 6, a lower wall 7, integral side edges 8 and 9, and an integral end wall 10, as noted. The interior 5 of the enclosure member affords a series of continuous interior surfaces, from these constructed walls, and which end, as at the location of the entrance 5, as aforesaid.

Proximate the interior of the enclosure member, at the location of the entrance 5, there is provided a fastening means, as at 11, and in this particular instance, the fastening means comprises what is generally identified as Velcro, normally being of the style of hook 12 and pile 13 type of fastener. The amount of Velcro required to insure temporary closure is all that is needed in application at this location, and the shorter the length of the fastener means employed increases the amount of capacity for the enclosure member, and the entire coin pouch, as in usage. On the other hand, it is just as likely that the length of the enclosure member 2, can be increased, in order to enhance the capacity of this coin pouch. Furthermore, it is possible that a snap clasp type of fastening means, or snap fastener as known in the trade, could be used at this location, as shown at 18 in FIG. 4, but it has been found that applying Velcro, for this purpose, provides reasonable securement and retention of any coins within this pouch, and yet affords very facile and facilitates the opening as required. In addition, locating the fastening means at approximate the central location at the entrance of the enclosure member, as shown in FIGS. 5 and 6, is normally sufficient to provide a lock for retention of coins therein, since the smallest of coins easily has a dimension greater than the distance between the edges of the shown Velcro, and the side walls of the pouch, to prevent any inadvertent loss of coins from the pouch, as during storage.

As can be seen in various of the figures of the drawings, the coin pouch of this invention may be used in conjunction with a key ring, as at 14, key chain, or the like. It includes a link means, as at 15, which surrounds the ring, as shown, with the link means incorporating its own locking means, as at 16, that inserts through an aperture, as at 17, provided through both walls of the pouch, for locking into permanent engagement, for securement by means of said link of the key ring thereto. On the other hand, it is just as likely that a small key chain could insert through the aperture 17, or be held by the link, and function as a means for holding keys, or the like, to the coin pouch, should this be desired. Additionally, the coin pouch could be used independently, without any link, ring, chain, or the like.

Variations or modifications to the subject matter of this invention may occur to those skilled in the art upon reviewing the invention as described herein. Such variations or modifications, if within the spirit of this invention, are intended to be encompassed within the scope of any claims to patent protection issuing upon this development. The description of the preferred embodiment set forth herein is done so for illustrative purposes only.

Having thus described the invention, what is claimed and desired to be secured by Letters Patent is:

1. A coin pouch including an enclosure member having a cavity therein, and further having at least one entrance at one end, said enclosure member formed of a polymer material and being sufficiently resilient to allow its compression to attain an opening of its entrance end to achieve deposit or withdrawal of coins from there within, but due to its inherent resiliency allowing the enclosure member, at its entrance, to inherently shift into closure, and a fastening means attaching to the enclosure member at its entrance to temporarily secure it into closure, said enclosure member being formed of a polyvinyl chloride, said polyvinyl chloride having a Shore hardness of between about 70–75, said enclosure member having upper, lower, side and one end wall, all of said walls being integrally formed together to attain a unitary member, said entrance being located at the opposite end of the enclosure member from the said end wall, said fastening means comprising a hook and pile fastening means, said hook and pile fastening means being affixed respectively to the interior of said upper and lower walls proximate said entrance to maintain it in closure when said walls are compressed together, said upper and lower walls being in proximity with each other when said coin pouch is in its uncompressed condition and thereby having a spacing therebetween to provide for the contact and securement together of said hook and pile fastening means to retain the pouch cavity in closure, but that upon compressing of the coin pouch proximate its side walls tending to disconnect the hook and pile fastening means from each other to provide a forced opening to the entrance end of said pouch, said pouch being substantially longer than wider, and a key ring securing to the enclosure member at its end wall.

2. The invention of claim 1 and including a link securing said key ring to the enclosure member.

3. The invention of claim 2 and wherein said link stradling said enclosure member proximate its end wall, and said link including a clasp arranged for securing through the upper and lower walls of the enclosure member to secure the said link and key ring thereto.

4. A coin pouch including an enclosure member having a cavity therein, and further having at least one entrance at one end, said enclosure member formed of a polymer material and being sufficiently resilient to allow its compression to attain an opening of its entrance end to achieve deposit or withdrawal of coins from there within, but due to its inherent resiliency allowing the enclosure member, at its entrance, to inherently shift into closure, and a fastening means attaching to the enclosure member at its entrance to temporarily secure it into closure, said enclosure member being formed of a polyvinyl chloride, said polyvinyl chloride having a Shore hardness of between about 70–75, said enclosure member having upper, lower, side and one end wall, all of said walls being integrally formed together to attain a unitary member, said entrance being located at the opposite end of the enclosure member from the said end wall, said fastening means comprising a snap fastener type fastening means, said snap fastener type fastening means being affixed respectively to the interior of said upper and lower walls proximate said entrance to maintain it in closure when said walls are compressed together, said upper and lower walls being in proximity with each other when said coin pouch is in its uncompressed condition and thereby having a spacing therebetween to provide for the contact and securement together of said snap fastener type fastening means to retain the pouch cavity in closure, but that upon compressing of the coin pouch proximate its side walls tending to disconnect the fastening means from each other to provide a forced opening to the entrance end of said pouch, said pouch being substantially longer than wider, and a key ring securing to the enclosure member at its end wall.

* * * * *